US009957743B2

(12) United States Patent
Chen et al.

(10) Patent No.: US 9,957,743 B2
(45) Date of Patent: May 1, 2018

(54) SLOW CLOSING DOOR HINGE

(71) Applicants: Zheng Chen, San Jose, CA (US); Shangda Chen, Beijing (CN)

(72) Inventors: Zheng Chen, San Jose, CA (US); Shangda Chen, Beijing (CN)

( * ) Notice: Subject to any disclaimer, the term of this patent is extended or adjusted under 35 U.S.C. 154(b) by 27 days.

(21) Appl. No.: 14/763,316

(22) PCT Filed: Jan. 24, 2014

(86) PCT No.: PCT/CN2014/071232

§ 371 (c)(1),
(2) Date: Jul. 24, 2015

(87) PCT Pub. No.: WO2014/114251

PCT Pub. Date: Jul. 31, 2014

(65) Prior Publication Data

US 2015/0361708 A1 Dec. 17, 2015

(30) Foreign Application Priority Data

Jan. 24, 2013 (CN) ..... 2013 1 0027801

(51) Int. Cl.
*E05F 5/10* (2006.01)
*E05F 3/20* (2006.01)
(Continued)

(52) U.S. Cl.
CPC ..... *E05F 5/10* (2013.01); *E05D 3/02* (2013.01); *E05F 3/04* (2013.01); *E05F 3/20* (2013.01);
(Continued)

(58) Field of Classification Search
CPC ..... E05F 5/10; E05F 3/04; E05F 3/20; E05F 5/02; E05F 5/08; E05F 1/1207;
(Continued)

(56) References Cited

U.S. PATENT DOCUMENTS 3,401,422 A * 9/1968 Ventura ..... E05F 1/061 16/317
5,109,571 A * 5/1992 Ohshima ..... A47K 13/10 16/284

(Continued)

FOREIGN PATENT DOCUMENTS

CN 2559744 Y 7/2003
CN 1664294 A 9/2005

(Continued)

OTHER PUBLICATIONS

International Search Report (PCT/ISA/210) dated Apr. 28, 2014, by the State Intellectual Property Office of the P. R. China as the International Searching Authority for International Application No. PCT/CN2014/071232.

(Continued)

*Primary Examiner* — William Miller
(74) *Attorney, Agent, or Firm* — Buchanan Ingersoll & Rooney PC

(57) ABSTRACT

A slow-closing door hinge, includes a first foldout and a second foldout having a shaft sleeve respectively. A fixed rod mounted in the sleeve of the first foldout, and a rotating rod mounted in the sleeve of the second foldout are connected by a connecting rod. The connecting rod and the fixed rod are movably connected, with a hollow groove at the joint. A restoring spring in contact with the fixed rod and fixed to the connecting rod in the hollow groove. The connecting rod is connected with the rotating rod in a coaxial, rotationally actuating manner. The forward and backward rotation of the fixed rod and the rotating rod cooperates with the restoring spring to drive the connecting rod in a reciprocal motion within the shaft sleeve.

9 Claims, 6 Drawing Sheets

(51) Int. Cl.

| | |
|---|---|
| ***E05F 5/02*** | (2006.01) |
| ***E05D 3/02*** | (2006.01) |
| ***E05F 5/08*** | (2006.01) |
| ***E05F 3/04*** | (2006.01) |
| *E05F 1/12* | (2006.01) |

(52) U.S. Cl.
CPC ..... *E05F 5/02* (2013.01); *E05F 5/08* (2013.01); *E05F 1/1207* (2013.01); *E05Y 2201/638* (2013.01); *E05Y 2900/132* (2013.01); *E05Y 2900/148* (2013.01); *Y10T 16/2766* (2015.01); *Y10T 16/2771* (2015.01); *Y10T 16/304* (2015.01)

(58) Field of Classification Search
CPC ..... Y10T 16/2766; Y10T 16/2769; Y10T 16/2774; Y10T 16/304; Y10T 16/61; Y10T 16/628; Y10T 16/5387; Y10T 16/540255; E05D 3/02; E05Y 2900/132; E05Y 2900/148; E05Y 2201/638
USPC ..... 16/52–54, 50, 82, 85, 303, 330
See application file for complete search history.

(56) References Cited

U.S. PATENT DOCUMENTS

| | | | | |
|---|---|---|---|---|
| 5,152,029 | A * | 10/1992 | Pai | E05D 5/10 16/54 |
| 5,966,776 | A | 10/1999 | Ona | |
| 6,178,597 | B1 | 1/2001 | Suzuki et al. | |
| 7,596,830 | B2 * | 10/2009 | Yin | G06F 1/1616 16/303 |
| 7,712,186 | B2 * | 5/2010 | Kang | E05D 11/1078 16/330 |
| 8,439,172 | B2 * | 5/2013 | Lee | A47K 13/12 16/330 |
| 8,898,860 | B2 * | 12/2014 | Bacchetti | E05F 1/1223 16/303 |
| 2005/0193523 | A1 | 9/2005 | Nam et al. | |
| 2008/0136297 | A1 | 6/2008 | Huang | |
| 2010/0270113 | A1 | 10/2010 | Ogawa | |
| 2015/0233164 | A1 * | 8/2015 | Bacchetti | E05F 3/20 16/54 |

FOREIGN PATENT DOCUMENTS

| | | | | |
|---|---|---|---|---|
| CN | 101382024 | A | | 3/2009 |
| CN | 201372657 | Y | | 12/2009 |
| CN | 102409915 | A | | 4/2012 |
| CN | 203113980 | U | | 8/2013 |
| CN | 203755874 | U | * | 8/2014 |
| CN | 204476066 | U | * | 7/2015 |
| WO | 03/067011 | A1 | | 8/2003 |

OTHER PUBLICATIONS

Extended Search Report issued by the European Patent Office in corresponding European Patent Application No. 14742970.8 dated Sep. 8, 2016 (9 pages).

* cited by examiner

SLOW CLOSING DOOR HINGE

TECHNICAL FIELD

The invention belongs to the technical field of hinge, in particular to a slow-closing door hinge.

BACKGROUND

Generally, the door hinge is ordinary hinge, and the method by which the door slowly closes is to provide door closers on the door. But the structure of the door closers is complex, and is not conducive to the beautiful appearance. Thus, a slow-closing door hinge with simple structure and connecting with the hinge together is desired.

Chinese application No: CNO2243797.5 discloses a slow-closing door hinge, which includes a hinge consisting of an active foldout, a fixed foldout and a shaft. A hydraulic damping device is provided in the door or the door frame and a connecting transmission device for connecting the foldout and the hydraulic damping device. The hydraulic damping device of the slow-closing door hinge plays a buffer role during the door and window being opening or closing. The problem that there is no he hydraulic damping device in the existed hinge, and adding the hydraulic damping device to affect the appearance of the window and door and so on, is solved. But the above structure is larger.

The connecting of the connecting rod relatively fragile, easily damaged. And the production and installation is more trouble.

Chinese patent application No: CN200710146296.8 discloses a slow-closing door hinge, which includes two foldouts with shaft sleeve and a linkage mechanism within the shaft sleeve which are correspond to one of shaft sleeve respectively. Two shaft sleeve correspondingly are interlocked up and down via the linkage mechanism. The linkage mechanism includes a linkage buffer mechanism for preventing door and window from being closed too fast. The linkage buffer mechanism consists of a shaft body, a lifting rod which is on one end of the shaft body and can move up and down relative to the shaft body along the axial direction, and a buffer for buffering the lifting rod moving up and down to buffer the relative rotation of the lifting rod. Among them, the shaft body and a shaft sleeve are relatively fixed and rotate together in a coaxial, By the clamping connection between the lifting rod and the shaft sleeve of another hinge, the lifting rod can lift up and down, when the lifting rod and the hinge fixedly rotate. Compared to the previous slow-closing door hinge, the structure of the slow-closing door hinge is relatively simple, and the size is small. But the structure of the buffer mechanism with multi elements is still more complex, and is not conducive to the installation. And the structure of some foreign the slow-closing door hinge is more complex, and prone to failure in use, thus buffer function disappears.

SUMMARY OF THE INVENTION

In order to overcome the disadvantages such as structure complex, multi elements, and the existing slow-closing door hinge being difficultly installed, the invention provides a slow-closing door hinge, of which the structure is simple, and the elements are few, and the size is small and the installation is convenient, and the performance is good, and the door swing angle is big. There is a wide application. It is no need to distinguish left and right door in use, and it can be avoided that buffer function disappears in failure.

In order to solve the technical problem, a scheme of the invention is:

a slow-closing door hinge, includes a first foldout and a second foldout having a shaft sleeve respectively, wherein a fixed rod is fixedly mounted in the shaft sleeve of the first foldout, and a rotating rod is fixedly mounted in the shaft sleeve of the second foldout, and a connecting rod connects the fixed rod with the rotating rod. The connecting rod and the fixed rod are flexibly connected. A hollow groove is provided on a joint, and a restoring spring being in contact with the fixed rod and being fixed to the connecting rod is provided in the hollow groove. The connecting rod is connected with the rotating rod in a coaxial, rotationally actuating manner. The connecting rod is driven to reciprocally move within the shaft sleeve by the relative forward and backward rotation of the fixed rod and the rotating rod and the restoring spring. The structure of the slow-closing door hinge is simple, the elements are few, and the performance is good.

A means of flexible connection between the connecting rod and the fixed rod, by which the connecting rod and the fixed rod relatively move along the axial direction, and not relatively rotate, includes clamping connection or slot connection or spline connection or cross pin connection.

Preferably, the clamping connection structure is as follows: a convex block and a first chute groove matched with the convex block are respectively provided on a contact end surfaces of the fixed rod and the connecting rod. The convex block is in the first chute groove, so that the connecting rod is slidable in the axial direction, and is fixed in the circumferential direction. The convex block is provided on the contact end surface of the fixed rod or the contact end surface of the connecting rod, and the first chute groove is provided on the contact end surface of the connecting rod or the contact end surface of the fixed rod. The hollow groove is formed by engaging the convex block with the first chute groove.

The structure of the coaxial, rotationally actuating manner between the connecting rod and the rotating rod is as follows: a undulating chute is provided on the contact end surfaces of the connecting rod and the rotating rod respectively. The undulating chute includes a convex portion, a concave portion, and a slope between the convex portion and the concave portion. When the connecting rod and the rotating rod rotate relatively, the dislocation of the concave portion and the convex portion of the undulating chute changes the axial displacement of the connecting rod 4 and the rotating rod.

The convex portion of the undulating chute is convex flat surface or convex cambered surface, and the concave portion is concave flat surface or concave cambered surface, and the slope is a smooth transition bevel between the concave portion and the convex portion.

The arc length of the concave flat surface or concave cambered surface is related with the angle of the foldouts in buffering.

The convex portion or the concave portion of the undulating chute of the rotating rod is engaged with the concave portion or the convex portion of the undulating chute of the connecting rod each other. Two undulating chutes engage with each other to form a tank cavity intermediately for containing liquid oil.

One end of the connecting rod which is contact with the rotating rod is a closed end. The center of the end face of the closed end is provided with the pore path via which the liquid oil flows into the hollow groove from the tank cavity. The pore path extends to the hollow groove along the connecting rod axially. A check valve for controlling the liquid oil flow is provided at the outlet of the pore path.

An outlet of the pore path of the connecting rod further comprises a security valve by which the liquid oil flows into the tank cavity when the hollow groove of the connecting rod reaches a certain pressure. The security valve and the check valve are arranged in parallel. Thus, the pressure releases timely to prevent the hinge from damage, when the pressure in the hollow groove is too high.

The fixed installation between the shaft sleeve of the first foldout and the fixed rod, or between the shaft sleeve of the second foldout and the rotating rod, comprises pin-fixed manner, spline-fixed manner or slot screws fixed manner.

In order to solve the technical problem, another technical scheme the invention is:

a slow-closing door hinge, including a first foldout and a second foldout having a shaft sleeve respectively. Wherein a buffer is fixedly mounted in the shaft sleeve of the first foldout, and a rotating rod is fixedly mounted in the shaft sleeve of the second foldout. The rotating rod is connected with the buffer by a connecting rod. One end of the connecting rod is connected with the rotating rod in a coaxial, rotationally actuating manner. The connecting rod and the shaft sleeve are movably connected. The other end of the connecting rod is connected with the buffer in touch. So, the relative forward and backward rotation of the rotating rod and the connecting rod make the connecting rod axially move, and not rotate relatively, thereby the buffer is driven to reciprocally move within the shaft sleeve.

The structure of coaxially rotationally actuating between one end of the connecting rod and the rotating rod is as follows: an undulating chute is respectively provided on the contact end surfaces of the connecting rod and the rotating rod. The undulating chute includes a convex portion, a concave portion, and a slope between the convex portion and the concave portion. When the connecting rod and the rotating rod rotate relatively, the dislocation of the concave portion and the convex portion of the undulating chute changes the axial displacement of the connecting rod and the rotating rod.

The convex portion of the undulating chute is convex flat surface or convex cambered surface, and the concave portion is concave flat surface or concave cambered surface, and the slope is a smooth transition bevel between the concave portion and the convex portion. The convex portion or the concave portion of the undulating chute of the rotating rod is engaged with the concave portion or the convex portion of the undulating chute of the connecting rod each other.

The arc length of the concave flat surface or concave cambered surface is related with the angle of the two hinges when slow-closing.

The movably connected structure between the connecting rod and the shaft sleeve is a structure by which the connecting rod moves relatively along the axial direction, and not rotates relatively in the shaft sleeve. A pin hole is provided on the connecting rod. A second chute groove is provided on the shaft sleeve corresponding to the position of the pin hole. The pin extends through the pin hole of the connecting rod, and the ends of the pin are slidably placed in the second chute groove, so that the connecting rod is fixed in a circumferential direction in the shaft sleeve.

The movably connected structure between the connecting rod and the shaft sleeve is a structure by which the connecting rod relatively moves along the axial direction, not relatively rotates in the shaft sleeve. A second chute groove is provided on the connecting rod. A pin hole is provided on the shaft sleeve corresponding to the position of the second chute groove. The pin extends through the second chute groove of the connecting rod, and is fixed in the pin hole of the shaft sleeve. The pin extends through the second chute groove, so that the connecting rod is slidable in axial direction and fixed in circumferential direction in the shaft sleeve.

The movably connected structure between the connecting rod and the shaft sleeve is a spline structure by which the connecting rod relatively moves along the axial direction and not relatively rotates in the shaft sleeve. A splined mating structure is arranged on the inner peripheral wall of the connecting rod and the outer peripheral wall of the shaft sleeve respectively in the axial direction.

Preferably, the buffer is a hydraulic buffer. One end of the hydraulic buffer is provided with a piston rod, and connected to the connecting rod contiguously, and the other end of the hydraulic buffer is fixed with the shaft sleeve of the first foldout.

The contiguously connected structure between the hydraulic buffer and the connecting rod is a clamping connection between the piston rod of the hydraulic buffer and the connecting rod. One end of the connecting rod which contacts with the hydraulic buffer is a closed end. The end face of the closed end corresponding to the position of the piston rod is provided with a jack matching the piston rod. The piston rod inserts into the jack so that the sliding of the connecting rod in axial direction matching the piston rod drives the buffer to move reciprocally within the shaft sleeve.

The fixed installation manner between the shaft sleeve of the first foldout and the buffer, or, between the shaft sleeve of the second foldout and the rotating rod comprises a pin-fixed manner, spline-fixed manner or slot screws fixed manner.

The beneficial effects of the present invention is as follows: the slow-closing door hinge with the wide application range, of which the structure is simple, the parts are few, the size is small, the installation is convenient, the performance is good, and the door swing angle is big, does not distinguish left and right door. In use, it is avoided that buffer function disappears when failure.

DESCRIPTION OF DRAWINGS

The invention of the slow-closing door hinge is described further combined with the drawings.

Figure 1:
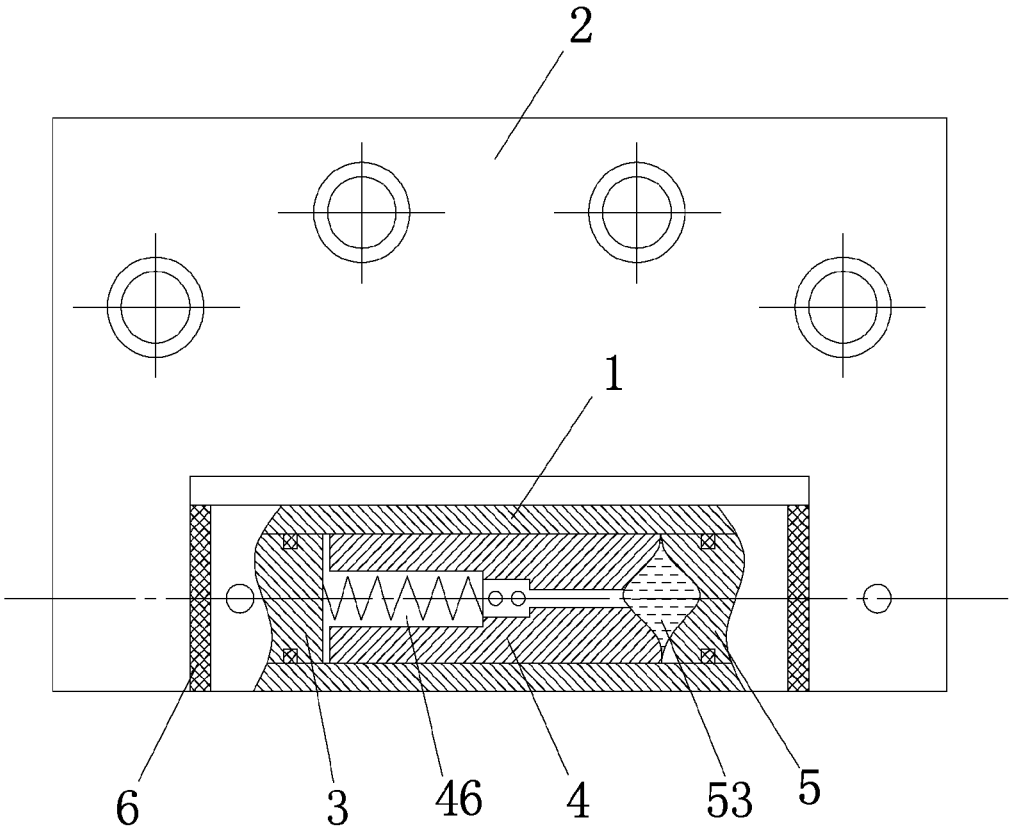
FIG. 1 is a schematic illustration of the whole structure of the embodiment 1 of the present invention.

As the figures shown, in Embodiment 1: the first foldout 1; the second foldout 2; the fixed rod 3; the convex block 31; the fixed hole 32 of the fixed rod; the seal ring 33 of the fixed rod; the connecting rod 4; the first chute groove 41; the undulating chute 42 of the connecting rod; the convex portion 421; the concave portion 422; the slope 423; the pore path 43; the check valve 44; the restoring spring 45; the hollow groove 46; the security valve 47; the rotating rod 5; the undulating chute 51 of the rotating rod; the convex portion 511; the concave portion 512; the slope 513; the fixed hole 52 of the rotating rod; the tank cavity 53; the seal ring 54 of the rotating rod; the gap 6;

In Embodiment 1: the first foldout 1'; the second foldout 2'; the connecting rod 4'; the undulating chute 42' of the connecting rod; the convex portion 421'; the concave portion 422'; the slope 423'; the rotating rod 5'; the undulating chute 51' of the rotating rod; the convex portion 511'; the concave portion 512'; the slope 513'; the fixed hole 52' of the rotating rod; the seal ring 54' of the rotating rod; the gap 6'; the buffer 7; the piston rod 71, the jack 72, the shaft sleeve 8'; the pin hole 9, the second chute groove 10, the pin 11.

Embodiment

Embodiment 1

As FIG. 1 shown, a slow-closing door hinge comprises a first foldout 1 and a second foldout 2 respectively having a shaft sleeve. A fixed rod 3 is fixedly mounted in the shaft sleeve of the first foldout 1, and a rotating rod 5 is fixedly mounted in the shaft sleeve of the second foldout 2. A connecting rod 4 is provided between the fixed rod 3 and the rotating rod 5 for connecting the fixed rod 3 and the rotating rod 5. The connecting rod 4 and the fixed rod 3 are movably connected, namely, the connecting rod 4 and the fixed rod 3 relatively move along the axial direction, not relatively rotate. A hollow groove 46 is provided on the connecting rod 4 at a joint. A restoring spring 45 is arranged in the hollow groove, and is in contact with the fixed rod 3, so that the connecting rod 4 moves in axial direction of the shaft sleeve of the first foldout 1, not rotates corresponding to the first foldout 1. A means of flexible connection includes clamping connection, or slot connection, or spline connection, or cross pin connection. The slot connection, the spline connection or the cross pin connection is the conventional technology means. The clamping connection structure is as follows: a convex block 31 and a first chute groove 41 matched with the convex block are respectively provided on the contact end surfaces of the fixed rod 3 and the connecting rod 4 being contact with each other, and the convex block 31 is in the first chute groove 41, so that the connecting rod 4 is slidable in the axial direction, and is fixed in the circumferential direction. The convex block 31 is provided on the contact end surface of the fixed rod 3 or the connecting rod 4, and the first chute groove 41 corresponding to the convex block 31 is provided on the contact end surface of the connecting rod 4 or the fixed rod 3. The number of the convex block and the first chute groove may be one, or two, or multiple. In the embodiment, the number of the convex block and the first chute groove are respectively taken two as an example.

Figure 2:
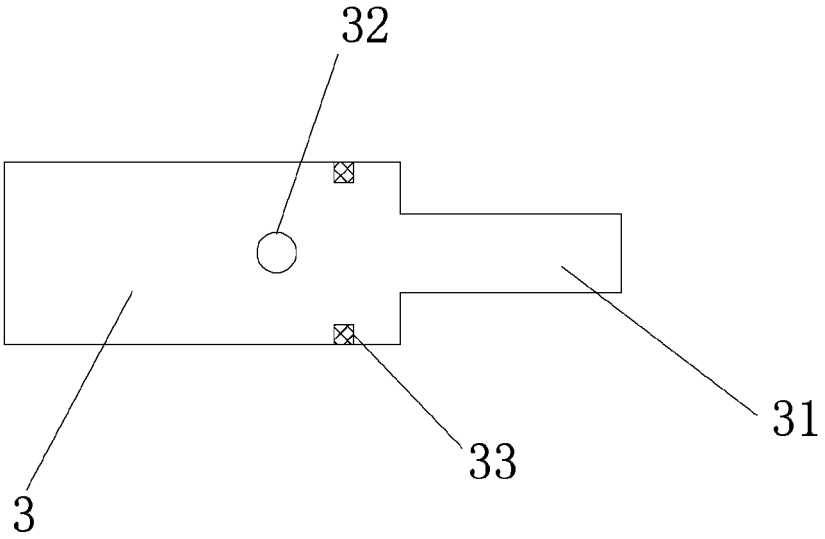
FIG. 2 is a schematic illustration of the structure of the fixed rod of the embodiment 1 of the present invention.

As FIG. 2 shown, the end surface of the fixed rod 3 is provided with two convex blocks 31, and the end surface of the connecting rod 4 contacted with the fixed rod 3 is provided with two first chute groove 41 matched with the convex block on the connecting rod. The convex block is connected with the first chute groove in the manner of clamping, so that the connecting rod 4 moves in axial direction in the shaft sleeve, not rotating about the shaft sleeve. It may also be, the end surface of the connecting rod 4 is provided with two convex blocks, and the end surface of the fixed rod 3 contacted with the fixed rod 3 is provided with two first chute groove 41 matched with the convex block of the connecting rod 4. The convex block are connected with the first chute groove in the manner of clamping, so that the connecting rod 4 moves in axial direction in the shaft sleeve, not rotating about the shaft sleeve. The convex block is the one selected from various shapes, such as a long strip, round. The first chute groove 41 is mutually matched with the convex block in the manner of clamping. The hollow groove 46 is formed by engaging the convex block 31 with the first chute groove 41. The restoring spring 45 is provided in the hollow groove, and the restoring spring 45 is in contact with the fixed rod 3.

The connection mode, by which the connecting rod 4 moves in axial direction in the shaft sleeve of the first foldout 1, not rotating relative to the first foldout 1, also can be gap spline connected, cross pin connected, or socket connected, etc. between the connecting rod 4 and the shaft sleeve of first foldout 1.

The rotating rod 5 is connected with the connecting rod 4 in a coaxial, rotationally actuating manner. The structure of the coaxial, rotationally actuating manner is as follows:

the undulating chute is respectively provided on the contact end surfaces of the connecting rod 4 and the rotating rod 5, and the undulating chute is composed of a convex portion, a concave portion, and a slope between the convex portion and the concave portion. The convex portion is convex flat surface or convex cambered surface, and the concave portion is concave flat surface or concave cambered surface, and the slope is a smooth transition bevel between the concave portion and the convex portion. The undulating chute of the rotating rod 5 is engaged with that of the connecting rod 4 each other. When the connecting rod 4 and the rotating rod 5 rotating relatively, the dislocation of the concave portion and the convex portion of the undulating chute changes the axial displacement of the connecting rod 4 and the rotating rod 5.

Figure 3:
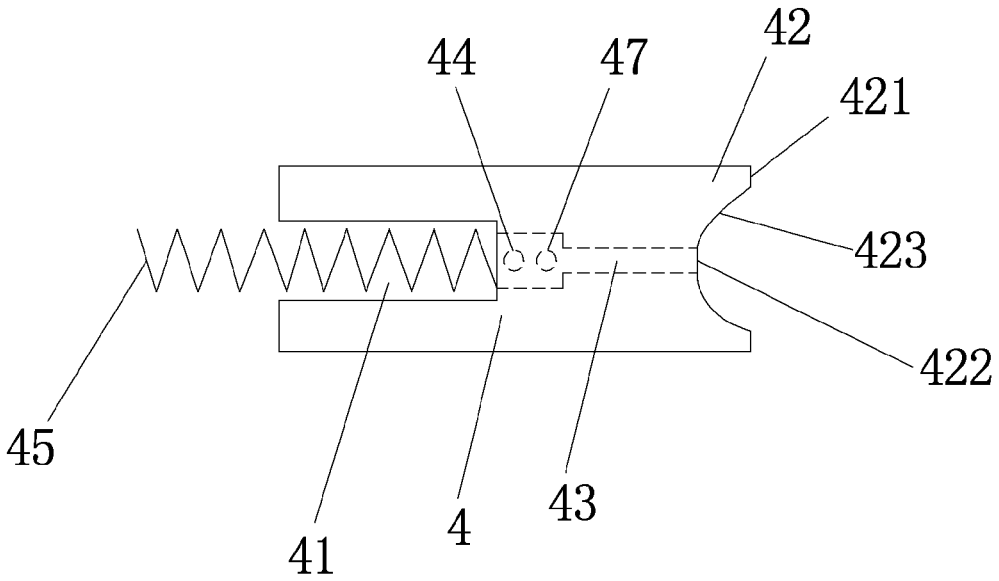
FIG. 3 is a schematic illustration of the structure of the connecting rod of the embodiment 1 of the present invention.
Figure 4:
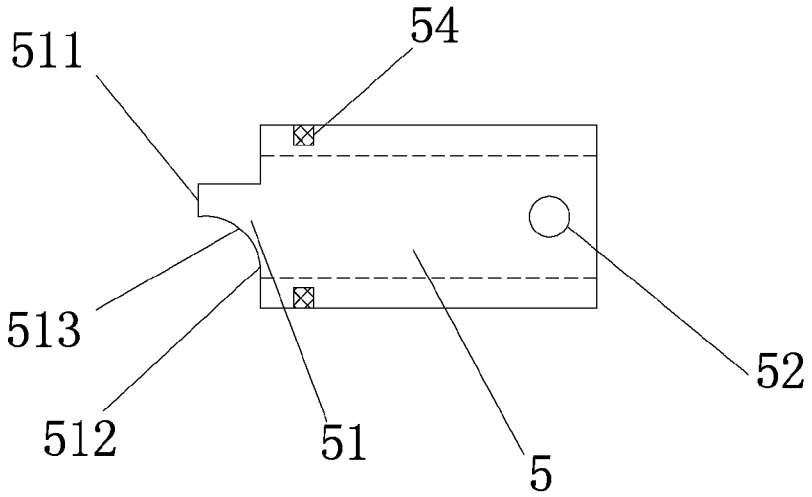
FIG. 4 is a schematic illustration of the structure of the rotating rod of the embodiment 1 of the present invention.

As FIGS. 3 and 4 shown, the undulating chute 42 of the connecting rod 4 is consisted of the convex portion 421, the concave portion 422, and the slope 423 for smooth transition between the convex portion and the concave portion. The rotating rod 5 is provided with the undulating chute 51 which has the same shape with the undulating chute 42. The undulating chute 51 is consisted of the convex portion 511, the concave portion 512, and the slope 513 for smooth transition between the convex portion and the concave portion. The convex portion of the undulating chute is convex flat surface or convex cambered surface, and the concave portion is concave flat surface or concave cambered surface. The undulating chute of the connecting rod 4 is engaged with that of the rotating rod 5 each other. When the connecting rod 4 and the rotating rod 5 rotating relatively, the undulating chute rotates relatively about the axis and along the convex flat surface or convex cambered surface, the slope, the concave flat surface or the concave cambered surface, such that the rotating rod 5 pushes the connecting rod 4 along the axial direction, and there is a displacement in the axial direction.

As FIGS. 1, 3, and 4 shown, the convex portion 511 of the undulating chute of the rotating rod 5 is engaged with the concave portion 422 of the undulating chute of the connecting rod 4 each other, and the concave portion 512 of the undulating chute of the rotating rod 5 is engaged with the convex portion 421 of the undulating chute of the connecting rod 4 each other. Two undulating chutes engage with each other to form a tank cavity 53 intermediately for containing liquid oil.

As FIG. 3 shown, one end of the connecting rod 4 which is contact with the rotating rod 5 is a closed end. The center of the end face of the closed end is provided with a pore path 43 via which the liquid oil flows into the connecting rod from the tank cavity 53. A security valve 47 for controlling the liquid oil flow and a check valve are provided at the outlet of the pore path 43. The security valve 47 and the check valve 44 are arranged in parallel. When the pressure of the hollow groove 46 of the connecting rod exceeds the set value, the security valve 47 is open for allowing liquid oil to flow into the tank cavity 53.

The fixed installation between the shaft sleeve of the first foldout 1 and the fixed rod 3, or between second foldout 2 and the rotating rod 5 is various, for example the pin, the spline or the slot screws. The fixed installation manner between the shaft sleeve of the first foldout 1 and the fixed rod 3 is same with that between second foldout 2 and the rotating rod 5, or different from that between second foldout 2 and the rotating rod 5.

As FIG. 2 shown, the fixed rod 3 is cylinder, and a fixing hole 32 is provided on the fixed rod 3. The fixing hole 32 is corresponding to the positioning hole of the shaft sleeve of the first foldout 1. The fixed rod is fixed to the shaft sleeve of the first foldout 1 together by a pin. Alternatively, a screw is provided on the fixed rod 3, and a screw slot is correspondingly provided on the first foldout 1, thus, the fixed rod is fixed to the shaft sleeve of the first foldout 1 together by the screw. Alternatively, a spline is provided on the fixed rod 3, and a groove is correspondingly provided on the first foldout 1, thus, the fixed rod is fixed to the shaft sleeve of the first foldout 1 together by the spline.

As FIG. 4 shown, one end of the rotating rod 5 is closed by a bolt, and the other end is a hollow end. The hollow end is rotationally actuating connected with the connecting rod 4 through the undulating chute. A fixing hole 52 is provided on the closed end with the bolt of the rotating rod 5. The fixing hole 52 is corresponding to the positioning hole of the shaft sleeve of the second foldout 2. The rotating rod is fixed with the shaft sleeve of the second foldout 2 together by a pin. Alternatively, a screw is provided on the rotating rod 5, and a screw slot is correspondingly provided on the second foldout 2, thus, the rotating rod is fixed with the shaft sleeve of the second foldout 2 together by the screw. Alternatively, a spline is provided on the rotating rod 5, and a groove is correspondingly provided on the second foldout 2, thus the rotating rod is fixed with the shaft sleeve of the second foldout 2 together by the spline.

As FIGS. 2 and 4 shown, the fixed rod 3 and the rotating rod 5 are respectively provided with a circle of groove along the rod wall. A circle of seal ring (33, 54) is set in the groove for keeping good sealing effect, such that the liquid oil does not flow out from the shaft sleeve of the foldout, when flowing in the shaft sleeve of the foldout.

Alternatively, a circle of groove is arranged on the inner surface of the shaft sleeve of the foldout, and a circle of seal ring is set in the groove. As FIG. 1 shown, in order to avoid wear, there is a gap 6 at joint between both ends of the fixed rod 3 and the rotating rod 5 and the shaft sleeve of the foldout, and nylon pads, copper pads, or bearings, etc. is placed in the gap to prevent the friction damage.

As FIG. 1 shown, when the door is in the closed state, the undulating chute 51 of the rotating rod 5 is connected with the undulating chute 42 of the connecting rod 4, and the connecting rod 4 is pushed to the fixed rod 3, and the restoring spring 45 is compressed, and the liquid oil is stored in the tank cavity 53.

Figure 5:
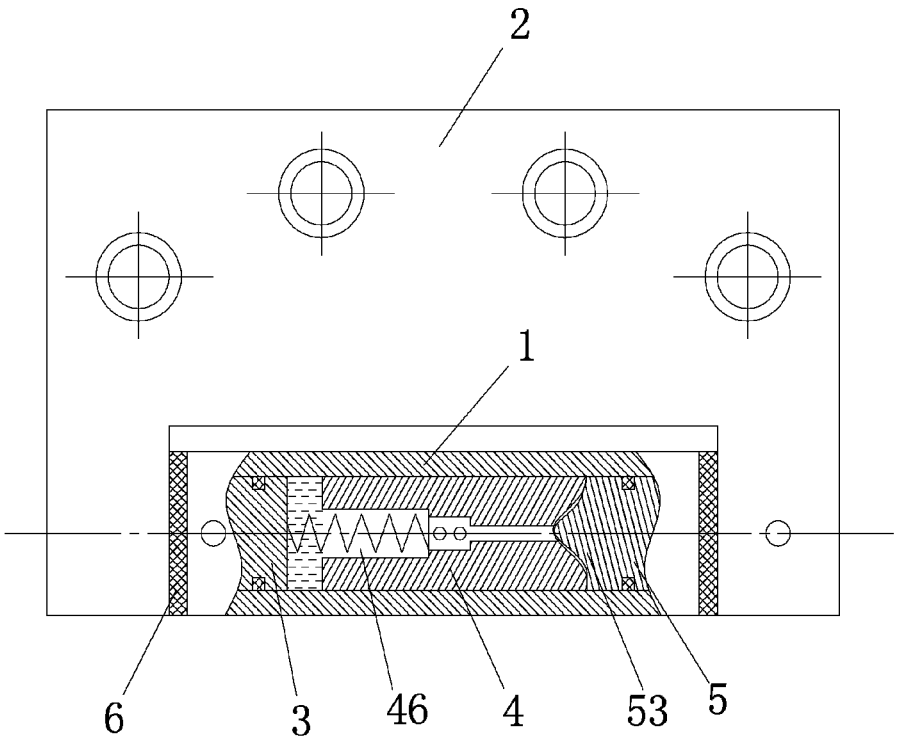
FIG. 5 is a schematic illustration of the structure of the door in an open state of the embodiment 1 of the present invention.

As FIG. 5 shown, when the door is opening, the foldout began to open, and the rotating rod 5 is driven to rotate, and the undulating chute 51 of the rotating rod rotates, so that the undulating chute 42 of the connecting rod 4 moves to the rotating rod 5 in the axial direction, and the restoring spring 45 slowly stretches. At this moment, the check valve 44 in the connecting rod 4 is open, and the liquid oil in the tank cavity 53 flows into the hollow groove 46 of the connecting rod through the pore path 43 on the center of the end surface of the connecting rod 4. When the door is opening to a certain angle, the sliding surface between the convex portion 511 of the rotating rod 5 and the concave portion 422 of the connecting rod 4 is concave surface or concave cambered surface, and the restoring spring 45 is no longer stretching. The connecting rod 4 stops moving, and the liquid oil stops flowing, until the door is open to the maximum. At this moment, the liquid oil is stored in the hollow groove 46.

As FIG. 1 shown, when the door is relaxed, the foldout began to close under the other external force, and the rotating rod 5 is driven to rotate, and the undulating chute 51 of the rotating rod rotates on the concave portion 422 of the undulating chute 42 of the connecting rod. When the door is closed to a certain angle, the connecting rod 4 and the rotating rod 5 are rotating relatively along the slope. So the connecting rod 4 moves to the fixed rod 3 in the axial direction, and the restoring spring 45 is slowly compressed, and the check valve 44 in the connecting rod 4 is closed. The liquid oil in the hollow groove 46 flow slowly into the tank cavity 53 through the aperture between the outer of the connecting rod 4 and the shaft sleeve of the foldout under the action of the pressure. Under the action of the hydraulic damping force of the liquid oil, the door slowly closes. When the door closes to an angle, and incompletely closes, the sliding surface between the convex portion 511 of the rotating rod 5 and the connecting rod 4 is convex surface or convex cambered surface, and the restoring spring 45 is no longer compressed. The connecting rod 4 stops moving, and the liquid oil is stored in the tank cavity 53, and the buffer is disappeared. The door is also provided with a hinge for closing automatically door. The hinge for closing door includes a closed-door spring. When the door slowly closes and the buffer disappears the door is quickly closed under the action of the closed-door spring of the hinge for closing door.

The arc length of the concave surface or concave cambered surface is related to the formed angles when the door hinge begins to buffer and the buffer disappears. When the arc length of the concave surface or concave cambered surface increasing, the angle of door opening when the buffer of door opening disappeared is decreasing, the angle of door closing when the buffer of door opening began is increasing, and the angle of door closing when the buffer of door opening disappeared is increasing.

When the door is in the opening state, the liquid oil is stored in the hollow groove 46 of the connecting rod. The door closes slowly under the action of other external forces, and the check valve 44 in the connecting rod 4 closes automatically, so a pressure is generated on the liquid oil in the hollow groove 46 hollow groove 46. When the pressure exceeds the set value, the security valve 47 opens, thus allows liquid oil to flow into the tank cavity 5 via the pore path 43 on the center of the end surface of the connecting rod 4, and reduces the pressure within the hollow groove 46. When the pressure returned to the normal, the door still slowly closes.

Embodiment 2

Figure 6:
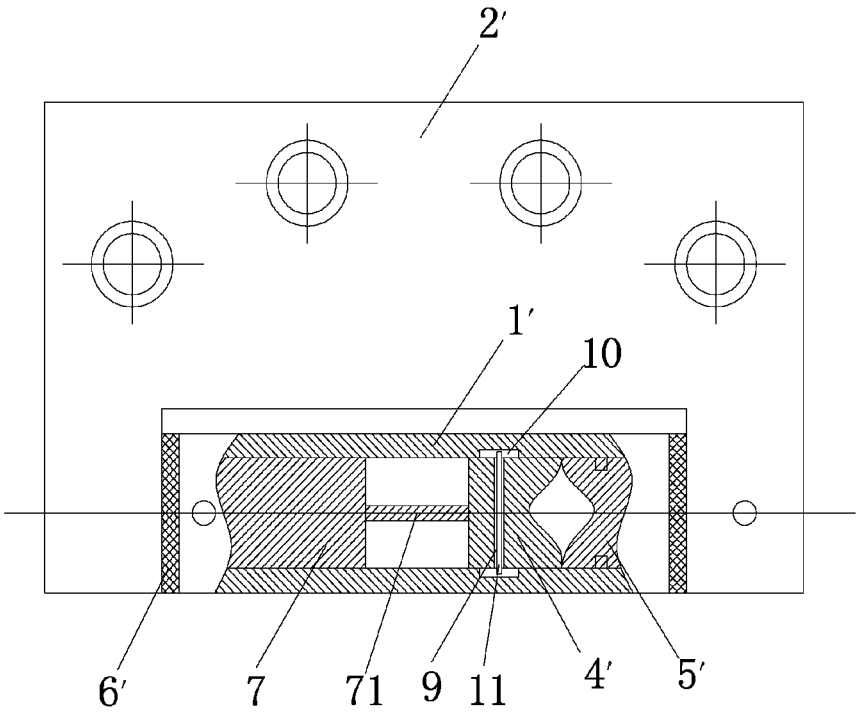
FIG. 6 is a schematic illustration of the whole structure of the embodiment 2 of the present invention.

As FIG. 6 shown, the slow-closing door hinge includes a first foldout 1' and a second foldout 2' respectively having a shaft sleeve. A buffer 7 is fixedly mounted in the shaft sleeve of the first foldout 1', and a rotating rod 5' is fixedly mounted in the shaft sleeve of the second foldout 2'. A connecting rod 4' is provided between the buffer 7 and the rotating rod 5' for connecting the buffer 7 and the rotating rod 5'.

As FIGS. 6, 7, 8, 9, and 10 shown, one end of the connecting rod 4' is connected to the rotating rod 5' in a coaxial, rotationally actuating manner, and the connecting rod 4' is movably connected with the shaft sleeve, so that the relative forward and backward rotation of the rotating rod 5' and the connecting rod 4' makes the connecting rod 4 axially move and not rotate relatively. The other end of the connecting rod 4' is touched and connected with the buffer 7, thereby, the axial movement of the connecting rod 4' drives the buffer 7 to reciprocally move in the axial direction of the shaft sleeve.

As FIGS. 7, 8, 9, and 10 shown, one end of the connecting rod 4' is connected with the rotating rod 5' in a coaxial, rotationally actuating manner. The structure of the coaxial, rotationally actuating manner is as follows: the undulating chute is respectively provided on the contact end surfaces of the connecting rod 4' and the rotating rod 5', and the undulating chute is composed of a convex portion, the concave portion, and a slope between the convex portion and the concave portion. The convex portion is convex flat surface or convex cambered surface, and the concave portion is concave flat surface or concave cambered surface, and the slope is a smooth transition bevel between the concave portion and the convex portion. The undulating chute of the rotating rod 5' is engaged with that of the connecting rod 4' each other. When the connecting rod 4' and the rotating rod 5' rotating relatively, the dislocation of the concave portion and the convex portion of the undulating chute changes the axial displacement of the connecting rod 4' and the rotating rod 5'.

As FIGS. 7, 8, 9, and 10 shown, the undulating chute 42' of the connecting rod 4' is consisted of the convex portion 421', the concave portion 422', and the slope 423' for smooth transition between the convex portion and the concave portion. The rotating rod 5' is provided with the undulating chute 51' which has the same shape with the undulating chute 42'. The undulating chute 51' is consisted of the convex portion 511', the concave portion 512', and the slope 513' for smooth transition between the convex portion and the concave portion. The convex portion of the undulating chute is convex flat surface or convex cambered surface, and the concave portion is concave flat surface or concave cambered surface. The undulating chute 42' of the connecting rod is engaged with the undulating chute 51' that of the rotating rod each other. When the connecting rod 4' and the rotating rod 5' rotating relatively, the undulating chute rotates relatively about the axis and along the convex flat surface or convex cambered surface, the slope, the concave flat surface or the concave cambered surface, such that the rotating rod 5' pushes the connecting rod 4' along the axial direction, and there is a displacement in the axial direction.

The undulating chute of the connecting rod 4' and the rotating rod 5' may be one, or two, or multiple. The number the undulating chute is related with the rotating angle of the connecting rod 4' and the rotating rod 5' on the undulating chute, and further related to the buffer angle when opening and closing.

As FIGS. 6, 7, 8, 9, and 10 shown, the convex portion 511' of the undulating chute of the rotating rod 5, is engaged with the concave portion 422' of the undulating chute of the connecting rod 4' each other, and the concave portion 512' of the undulating chute of the rotating rod 5' is engaged with the convex portion 421' of the undulating chute of the connecting rod 4' each other.

The arc length of the concave surface or concave cambered surface is related to the formed angles when the door hinge begins to buffer and the buffer disappears. When the arc length of the concave surface or concave cambered surface increasing, the angle of door opening when the buffer of door opening disappeared is decreasing, the angle of door closing when the buffer of door opening began is increasing, and the angle of door closing when the buffer of door opening disappeared is increasing.

Figure 7:
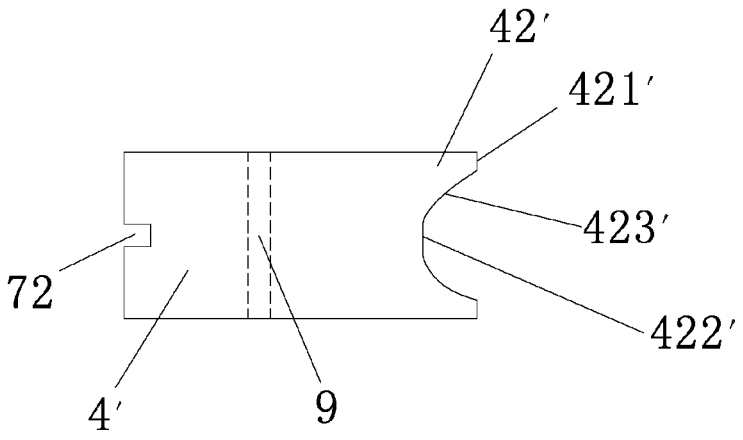
FIG. 7 is a schematic illustration of one structure of the connecting rod of the embodiment 2 of the present invention.
Figure 8:
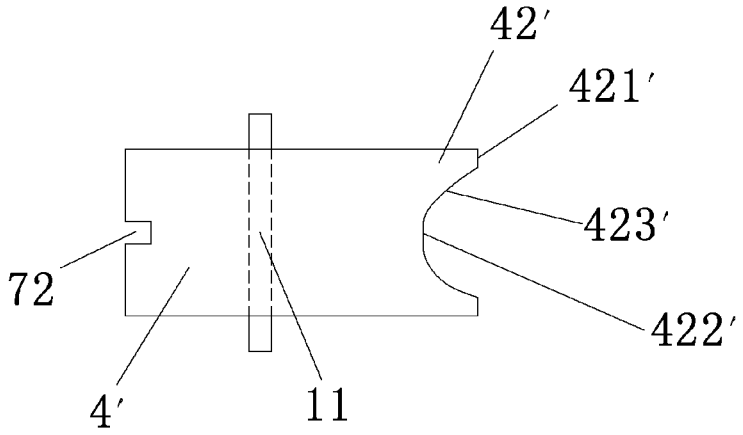
FIG. 8 is a schematic illustration of another structure of the connecting rod of the embodiment 2 of the present invention.
Figure 12:
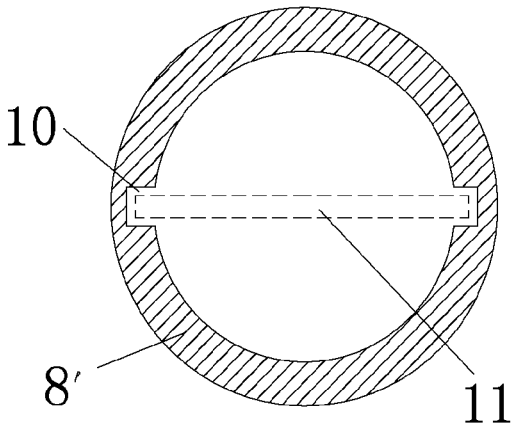
FIG. 12 is a schematic illustration of one movable connection structure between the connecting rod and the shaft sleeve of the embodiment 2 of the present invention.

As FIGS. 7, 8, and 12 shown, the movably connecting structure between the connecting rod 4' and the shaft sleeve 8' is a structure by which the connecting rod 4' relatively moves along the axial direction, and not relatively rotates in the shaft sleeve 8'. A pin hole 9 is provided on the connecting rod 4'. The pin hole 9 is a channel extending through the connecting rod 4'. A second chute groove 10 is provided on the shaft sleeve 8' corresponding to the pin hole 9. Due to the pin hole 9 extending through the connecting rod 4', the second chute groove 10 is respectively provided on the upper and lower position of the shaft sleeve 8' corresponding to the position of the pin hole 9. A pin 11 extends through the pin hole 9 of the connecting rod 4' and two ends of the pin are slidably placed in the second chute groove 10, so that the connecting rod 4' is slidable in the axial direction of the shaft sleeve 8, and fixed in the circumferential direction. The rotating rod 5' rotates positively and negatively relative to the connecting rod 4', and the rotating rod 5' drives the connecting rod 4', and drives the pin 11 extending through the pin hole 9 and the connecting rod 4' to move together. Whereas, the ends of the pin 11 are placed in the second chute groove 10 of the shaft sleeve 8', so the pin 11 can not rotate, and can slide in the second chute groove 10. Thus the connecting rod 4' changes the rotation to the axial movement. The connecting rod 4' only moves along the axial direction, not rotates relatively.

As FIG. 8 shown, it may also be that, the connecting rod 4' is formed integrally with the pin 11. Thus the structure is simple and stable. The connecting rod 4' and the pin 11 move in the second chute groove 10 in the axial direction together. There is no need to set the pin hole, and it is convenient to manufacture, and saving of the costs.

Figure 9:
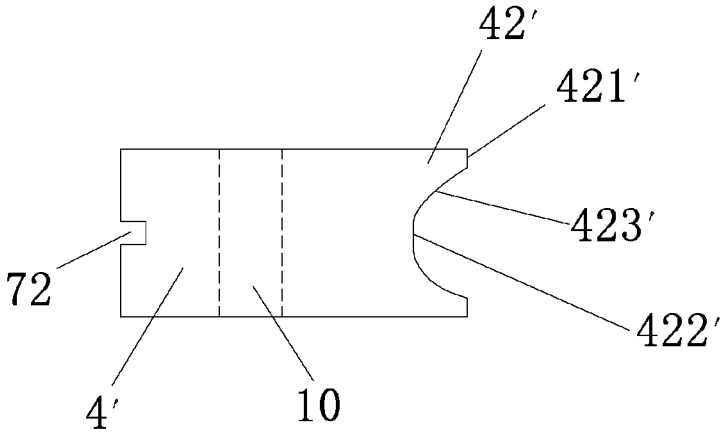
FIG. 9 is a schematic illustration of another structure of the connecting rod of the embodiment 2 of the present invention.
Figure 13:
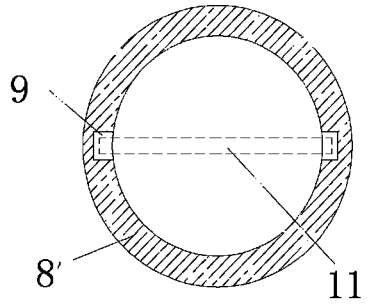
FIG. 13 is a schematic illustration of another movable connection structure between the connecting rod and the shaft sleeve of the embodiment 2 of the present invention.

As FIGS. 9 and 13 shown, the movably connected structure between the connecting rod 4' and the shaft sleeve 8' is the structure by which the connecting rod 4' relatively moves along the axial direction, and not relatively rotates in the shaft sleeve 8'. Alternatively, the second chute groove 10 is provided on the connecting rod 4', and the second chute groove 10 extends through the connecting rod 4'. The pin hole 9 is provided on the shaft sleeve 8' corresponding to the position of the second chute groove 10. The pin 11 extends through the second chute groove 10 of the connecting rod 4', and the two ends of the pin 11 is fixed in the pin hole 9 of the shaft sleeve 8'. Due the pin 11 extending through the second chute groove 10, the connecting rod 4' is slidable in the axial direction in the shaft sleeve 8' and fixed in a circumferential direction. The rotating rod 5' rotates positively and negatively relative to the connecting rod 4', and the rotating rod 5' drives the connecting rod 4' to move, Two ends of the pin 11 is fixed in the pin hole 9 of the shaft sleeve, and the pin 11 and the shaft sleeve 8' are relatively fixed, and not rotating and moving in the axial direction. Whereas, the pin 11 extends through the second chute groove 10 of the connecting rod, and the second chute groove 10 can slide in the axial direction relative to the pin 11, that is, the connecting rod 4' can slide in the axial direction. Therefore, under the action of the pin, the connecting rod 4' can not rotate, and can move in the axial direction.

The movably connected structure between the connecting rod 4' and the shaft sleeve 8' is a spline structure by which the connecting rod 4' relatively moves along the axial direction, and not relatively rotates in the shaft sleeve 8'. A splined mating structure is arranged on the inner peripheral wall of the connecting rod 4' and the outer peripheral wall of the shaft sleeve 8' respectively in the axial direction. Wherein, the spline structure is the common structure in the prior art.

In the embodiment, the buffer 7 is a hydraulic buffer. The buffer 7 is not limited in the hydraulic buffer, and other types of buffers can be selected, so long as the buffer effect can be achieved and the same function with the hydraulic buffer of the invention, which does not departing from the scope of the invention.

As FIGS. 7, 8, 9, and 10 shown, one end of the hydraulic buffer is provided with a piston rod 71, and connected with the connecting rod 4' contiguously. The other end of the hydraulic buffer is fixed to the shaft sleeve of the first foldout 1'. The contiguously connected structure between the hydraulic buffer and the connecting rod 4' is a clamping connection between the piston rod 71 of the hydraulic buffer and the connecting rod 4', so that the sliding of the connecting rod 4' in axial direction matching the piston rod 71 drives the buffer 7 to move in a reciprocal motion. The buffer effect is achieved. One end of the connecting rod 4' which contacts with the hydraulic buffer is a closed end. A jack 72 matching the piston rod 71 is set on the closed end corresponding to the position of the piston rod 71. The piston rod 71 inserts into the jack 72 so that the sliding of the connecting rod 4' in axial direction matching the piston rod 71 drives the buffer 7 to move in a reciprocal motion.

The fixed installation manner between the shaft sleeve of the first foldout 1' and the buffer 7, or between second foldout 2' and the rotating rod 5' is various, for example the pin, the spline or the slot screws. The fixed installation manner between the shaft sleeve of the first foldout 1' and the buffer 7 is same with, or different from that between second foldout 2' and the rotating rod 5', fixed installation manner.

Alternatively, a hole is provided on the buffer 7, the hole is corresponding to the positioning hole of the shaft sleeve of the first foldout 1'. The buffer 7 is fixed with the shaft sleeve of the first foldout 1' together by a pin. Alternatively, a screw is provided on the buffer 7, and a screw slot corresponding to the screw is provided on the first foldout 1'.The fixed rod is fixed with the shaft sleeve of the first foldout 1' together by the screw. Alternatively, a spline is arranged on the buffer 7, and a groove corresponding to the spline is arranged on the first foldout 1'. The fixed rod is fixed with the shaft sleeve of the first foldout 1' together by the spline. The fixed installation manner between the first foldout 1' and the buffer 7 may also be, the first foldout 1' is connected with the buffer 7 contiguously, without imposing a fixed manner. The buffer 7 is placed in the shaft sleeve of the first foldout 1'.

Figure 10:
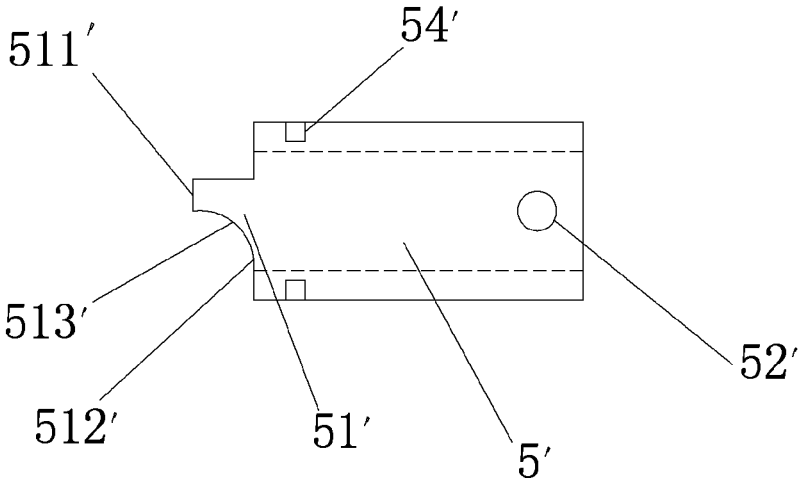
FIG. 10 is a schematic illustration of the structure of the rotating rod of the embodiment 2 of the present invention.
Figure 11:
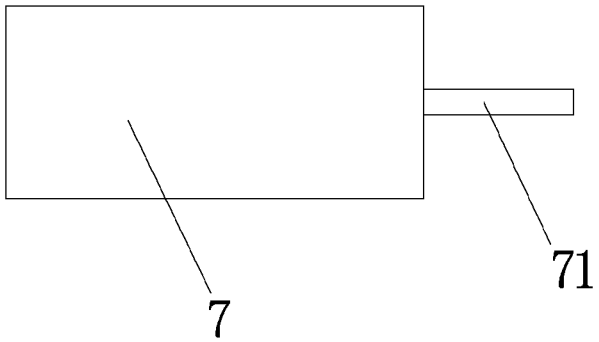
FIG. 11 is a schematic illustration of the structure of the buffer of the embodiment 2 of the present invention.

As FIG. 10 shown, one end of the rotating rod 5' is a closed end, and the other end is a hollow end. The hollow end is rotationally actuating connected with the connecting rod' through the undulating chute. A fixing hole 52' is provided on the closed end of the rotating rod 5'. The fixing hole 52' is corresponding to the positioning hole of the shaft sleeve of the second foldout 2'.The rotating rod is fixed with the shaft sleeve of the second foldout 2' together by a pin. Alternatively, a screw is provided on the rotating rod 5', and a screw slot is correspondingly provided on the second foldout 2', thus, the rotating rod is fixed with the shaft sleeve of the second foldout together by the screw. Alternatively, a spline is provided at the rotating rod 5', and a groove is correspondingly provided on the second foldout 2', thus the rotating rod is fixed with the shaft sleeve of the second foldout together by the spline.

As FIGS. 6, 10 shown, the rotating rod 5' is respectively provided with a circle of groove along the rod wall. A circle of seal ring 54' is set in the groove for keeping good sealing effect. Alternatively, a circle of groove is arranged on the inner surface of the shaft sleeve of the foldout, and a circle of seal ring is set in the groove. As FIG. 1' shown, in order to avoid wear, there is a gap 6' at joint between the buffer 7 and the rotating rod 5' and the shaft sleeve of the foldout, and nylon pads, copper pads, or bearings, etc. is placed in the gap to prevent the friction damage.

In the present invention, the first foldout 1' is same with or different from the second foldout 2'. The first foldout 1' and the second foldout 2' are single ear hinge, double ear hinge, and so on.

As FIG. 6 shown, when the door is in the closed state, the undulating chute 51' of the rotating rod 5' is connected with the undulating chute 42' of the connecting rod 4', and the connecting rod 4' is pushed to the buffer 7, and the piston rod 71 is compressed.

Figure 14:
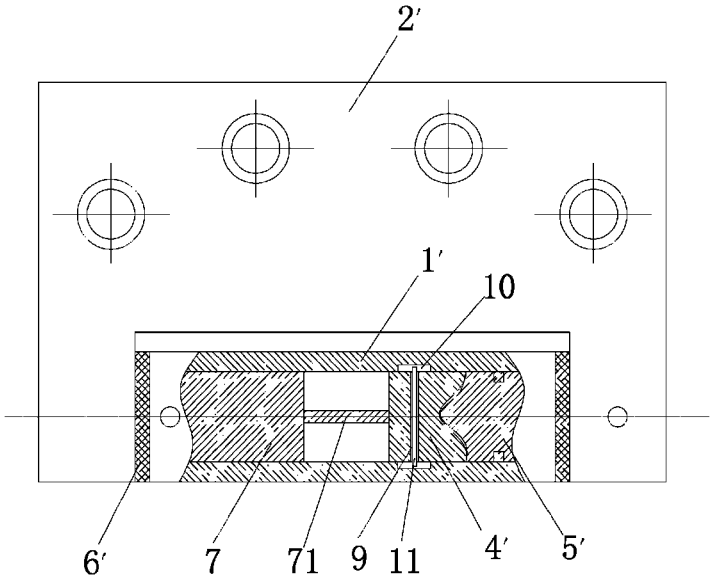
FIG. 14 is a schematic illustration of the structure of the door in an open state of the embodiment 2 of the present invention.

As FIG. 14 shown, when the door is opening, the foldout began to open, and the rotating rod 5' is driven to rotate, and the undulating chute 51' of the rotating rod rotates, so that the undulating chute 42' of the connecting rod 4' moves to the rotating rod 5' in the axial direction, and the piston rod 71 is slowly stretching. When the door is opening to a certain angle, the sliding surface between the convex portion 511' of the rotating rod 5' and the concave portion of the connecting rod 4' is concave surface or concave cambered surface, and the piston rod 71 is no longer stretching. The connecting rod 4' stops moving, until the door is open to the maximum.

As FIG. 6 shown, when the door is relaxed, the foldout began to close under the other external force, and the rotating rod 5' is driven to rotate, and the undulating chute 51' of the rotating rod rotates on the concave portion 422' of the undulating chute 42' of the connecting rod. When the door is closed to a certain angle, the connecting rod 4' and the rotating rod 5' are rotating relatively along the slope. So the connecting rod 4' moves to the hydraulic buffer in the axial direction, and the piston rod 71 is slowly compressing, and the hydraulic buffer is buffering, and the door is slowly closed. When the door closes to an angle, and incompletely closes, the sliding surface between the convex portion 511' of the rotating rod 5' and the connecting rod 4' is convex surface or convex cambered surface. The piston rod 71 is no longer compressing, and The connecting rod 4' stops moving, and the buffer is disappeared. The door is also provided with a hinge for closing automatically door. The hinge for closing door includes a closed-door spring. When the door slowly closes and the buffer disappears, the door is quickly closed under the action of the closed-door spring of the hinge for closing door.

The structure of the slow-closing door hinge in the invention is simple, and the the number of elements are fewer, and the size is small. The installation is convenient. The door swing angle is a range from 100° to 270°. The application range is wide. The slow-closing door hinge does not distinguish left and right door. And the performance of the slow-closing door hinge is good, and the slow-closing door hinge is suitable for all kinds of doors.

As mentioned above, the similar technical scheme can be derived from the above mentioned embodiment combined with the figures. But the schemes being simply modified, or equally transformed on the basis of the essence of the invention do not depart from the scope of the invention.

The invention claimed is:

1. A slow-closing door hinge, including a first foldout and a second foldout having a shaft sleeve respectively, wherein, a fixed rod is fixedly mounted in the shaft sleeve of the first foldout, and a rotating rod is fixedly mounted in the shaft sleeve of the second foldout, the fixed rod is connected with the rotating rod by a connecting rod, the connecting rod and the fixed rod are flexibly connected, and form a hollow groove, a restoring spring being in contact with the fixed rod and fixed to the connecting rod is provided in the hollow groove, the connecting rod is connected with the rotating rod in a coaxial, rotationally actuating manner, the connecting rod is driven reciprocally to move within the shaft sleeve by a relative forward and backward rotation of the fixed rod and the rotating rod cooperating with the restoring spring, and a structure of the coaxial rotational actuation of the connecting rod and the rotating rod is as follows:

an undulating chute is provided on a first contact end surface of the connecting rod and a contact end surface of the rotating rod, respectively, the undulating chute includes a convex portion, a concave portion, and a slope between the convex portion and the concave portion, and when the connecting rod and the rotating rod relatively rotate, a dislocation of the concave portion and the convex portion of the undulating chute changes the axial displacement of the connecting rod and the rotating rod.

2. The slow-closing door hinge according to claim 1, wherein, a means of flexible connection between the connecting rod and the fixed rod, by which the connecting rod relatively moves along an axial direction, and not relatively rotates, includes clamping connection or slot connection or spline connection or cross pin connection.

3. The slow-closing door hinge according to claim 2, wherein, a clamping connection structure is as follows:

a convex block is provided on a contact end surface of the fixed rod, and a first chute groove matched with the convex block is provided on a second contact end surface of the connecting rod, or the convex block is provided on the second contact end surface of the connecting rod, and the first chute groove matched with the convex block is provided on the contact end surface of the fixed rod, the convex block is in the first chute groove, so that the connecting rod is slidable in the axial direction, and is fixed in a circumferential direction, and the hollow groove is formed by engaging the convex block with the first chute groove.

4. The slow-closing door hinge according to claim 1, wherein, the convex portion of the undulating chute is a convex flat surface or a convex cambered surface, the concave portion is a concave flat surface or a concave cambered surface, and the slope is a smooth transition bevel between the concave portion and the convex portion.

5. The slow-closing door hinge according to claim 4, wherein, an arc length of the concave flat surface or concave cambered surface is related with an angle of the two foldouts in buffering.

6. The slow-closing door hinge according to claim 1, wherein, the convex portion or the concave portion of the undulating chute of the rotating rod is engaged with the concave portion or the convex portion of the undulating chute of the connecting rod each other, and the two undulating chutes engage with each other to form a tank cavity intermediately for containing liquid oil.

7. The slow-closing door hinge according to claim 1, wherein, one end of the connecting rod which is contact with the rotating rod is a closed end, a center of an end face of the closed end is provided with a pore path via which liquid oil flows into the hollow groove from a tank cavity, the pore path extends through the hollow groove along the connecting rod axially, a check valve for controlling the liquid oil flow is provided at the outlet of the pore path.

8. The slow-closing door hinge according to claim 7, wherein, the outlet of the pore path of the connecting rod further comprises a security valve by which the liquid oil flows into the tank cavity when the hollow groove of the connecting rod reaches a certain pressure, and the security valve and the check valve are arranged in parallel.

9. The slow-closing door hinge according to claim 1, wherein, a fixed installation between the shaft sleeve of the first foldout and the fixed rod, or between the second foldout and the rotating rod comprises pin-fixed manner, spline-fixed manner or slot screws fixed manner.

* * * * *